US009080471B2

(12) United States Patent
Pluta et al.

(10) Patent No.: US 9,080,471 B2
(45) Date of Patent: Jul. 14, 2015

(54) CAM TORQUE ACTUATED PHASER WITH MID POSITION LOCK

(75) Inventors: Christopher J. Pluta, Ithaca, NY (US); Mark Wigsten, Lansing, NY (US); Braman Wing, Interlaken, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 38 days.

(21) Appl. No.: 13/817,933

(22) PCT Filed: Oct. 28, 2011

(86) PCT No.: PCT/US2011/058290

§ 371 (c)(1),
(2), (4) Date: Feb. 20, 2013

(87) PCT Pub. No.: WO2012/061233

PCT Pub. Date: May 10, 2012

(65) Prior Publication Data

US 2013/0220253 A1 Aug. 29, 2013

Related U.S. Application Data

(60) Provisional application No. 61/409,340, filed on Nov. 2, 2010.

(51) Int. Cl.
*F01L 1/34* (2006.01)
*F01L 1/344* (2006.01)

(52) U.S. Cl.
CPC ..... *F01L 1/34409* (2013.01); *F01L 1/3442* (2013.01)

(58) Field of Classification Search
CPC ..... F01L 1/3442; F01L 2001/34423
USPC ..... 123/90.12, 90.17
See application file for complete search history.

(56) References Cited

U.S. PATENT DOCUMENTS

| | | | |
|---|---|---|---|
| 6,250,265 | B1 | 6/2001 | Simpson |
| 6,311,655 | B1 | 11/2001 | Simpson et al. |
| 6,382,155 | B2 | 5/2002 | Simpson |
| 6,453,859 | B1 | 9/2002 | Smith et al. |
| 6,477,999 | B1 | 11/2002 | Markley |

(Continued)

FOREIGN PATENT DOCUMENTS

WO WO 2009114500 A1 * 9/2009

*Primary Examiner* — Thomas Denion
*Assistant Examiner* — Daniel Bernstein
(74) *Attorney, Agent, or Firm* — Helmholdt Law PLC; Thomas D. Helmholdt

(57) ABSTRACT

A cam torque actuated variable cam timing phaser can include a rotor (20) enclosed by an endplate (64) within a housing (10). The housing (10) can have at least one cavity (10*a*) to be divided by a vane (22) rigidly attached to the rotor (20). The vane (22) can divide the cavity (10*a*) into a first chamber (16) and a second chamber (18). Passages (26, 28, 56, 58) can connect the first and second chambers (16, 18) facilitating oscillation of the vane (20) within the cavity (10*a*). A detent valve (50) can move between an open position and a closed position. When in the open position, the detent valve (50) can connect portions of a detent passage (56, 58) extending through the rotor (20) and through the endplate (64) allowing pressurized actuating fluid flow with respect to the first and second chambers (16, 18) in response to a relative angular position of the rotor (20) with respect to the endplate (64). A lock pin (60) can move between a locked position and a released position.

15 Claims, 6 Drawing Sheets

(56) References Cited

U.S. PATENT DOCUMENTS

| | | | |
|---|---|---|---|
| 6,481,402 | B1 | 11/2002 | Simpson et al. |
| 6,561,146 | B2 | 5/2003 | Todd et al. |
| 6,644,258 | B1 | 11/2003 | Smith |
| 6,647,936 | B2 | 11/2003 | Lewis |
| 6,666,181 | B2 | 12/2003 | Smith et al. |
| 6,668,778 | B1 | 12/2003 | Smith |
| 6,763,791 | B2 | 7/2004 | Gardner et al. |
| 6,766,777 | B2 | 7/2004 | Simpson et al. |
| 6,772,721 | B1 | 8/2004 | Gardner et al. |
| 6,799,544 | B1 * | 10/2004 | Pierik ..... 123/90.17 |
| 6,814,037 | B1 | 11/2004 | Smith et al. |
| 6,814,038 | B2 | 11/2004 | Smith |
| 6,883,479 | B2 | 4/2005 | Simpson |
| 6,941,913 | B2 | 9/2005 | Smith |
| 6,966,288 | B2 | 11/2005 | Simpson |
| 6,971,354 | B1 | 12/2005 | Smith et al. |
| 7,124,722 | B2 | 10/2006 | Smith |
| 7,137,371 | B2 | 11/2006 | Simpson |
| 7,318,401 | B2 | 1/2008 | Pluta et al. |
| 7,568,458 | B2 | 8/2009 | Roth et al. |
| 8,356,583 | B2 | 1/2013 | Smith |

* cited by examiner

CAM TORQUE ACTUATED PHASER WITH MID POSITION LOCK

FIELD OF THE INVENTION

The present invention relates to a mechanism intermediate a crank-shaft and a poppet-type intake or exhaust valve of an internal combustion engine for operating at least one such valve, wherein means are provided to vary a time period, extent of duration of valve opening relative to an operating cycle of the engine, and further wherein means are provided to vary a structure or an axial disposition of a camshaft or an associated cam of the camshaft.

BACKGROUND

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. A crankshaft can take power from the pistons to drive at least one transmission and at least one camshaft. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

As is conventional in the art, there can be one or more camshafts per engine. A camshaft can be driven by a belt, or a chain, or one or more gears, or another camshaft. One or more lobes can exist on a camshaft to push on one or more valves. A multiple camshaft engine typically has one camshaft for exhaust valves, one camshaft for intake valves. A "V" type engine usually has two camshafts (one for each bank) or four camshafts (intake and exhaust for each bank).

Variable camshaft timing (VCT) devices are generally known in the art, such as U.S. Pat. No. 5,002,023; U.S. Pat. No. 5,107,804; U.S. Pat. No. 5,172,659; U.S. Pat. No. 5,184,578; U.S. Pat. No. 5,289,805; U.S. Pat. No. 5,361,735; U.S. Pat. No. 5,497,738; U.S. Pat. No. 5,657,725; U.S. Pat. No. 6,247,434; U.S. Pat. No. 6,250,265; U.S. Pat. No. 6,263,846; U.S. Pat. No. 6,311,655; U.S. Pat. No. 6,374,787; and U.S. Pat. No. 6,477,999. Each of these prior known patents appears to be suitable for its intended purpose. However, it would be desirable to allow a check valve in spool cam torque actuated (CTA) phaser to lock somewhere along a path of travel, other than at either end stop limit of travel.

SUMMARY

The disclosed check valve in spool cam torque actuated (CTA) phaser with mid position lock allows a mid position lock with a hydraulic detent circuit in both a rotor and an endplate. A metering edge or edges of the hydraulic detent circuit can be controlled by a position of the end plate relative to the rotor. The hydraulic detent circuit can be activated by a position of a lock pin, where the detent valve can be integrated into the lock pin, but it is not necessary to do so. The lock pin can have two functions: first, to lock a phaser in a base timing position; and second, as a switch for the hydraulic detent circuit. A metering edge or edges for the hydraulic detent circuit can be located between the endplate and the rotor.

To lock the phaser, a spool can be positioned full out, where a lock passage supplying oil to a nose of the lock pin is blocked and a vent passage is opened allowing any remaining oil in the lock passage to be vented. A spring on a back side of the lock pin pushes the lock pin till the nose contacts a face of the endplate or sprocket which in turn allows an annulus on the lock pin to be aligned with three passages, where one passage connects to an advance chamber, another passage connects to a retard chamber and a last passage connects to a pressurized fluid supply passage. Depending on a position of the rotor, the two passages connected to the chambers are able to open and close, causing the rotor to move to a lock position, which only occurs when the lock pin nose is against the sprocket or endplate. When the rotor and sprocket are aligned in the locked position, the lock pin is able to fall into a corresponding aperture to lock the phaser. The two passages are controlled by the rotor to endplate position providing a configuration that does not require an internal bearing.

To unlock the phaser, the spool valve is pushed inward blocking the vent passage and allowing supply oil to be feed to the nose of the lock pin, the supply oil pushes against the nose of the lock pin causing it to retract which unlocks the phaser (compressing the lock pin spring). Once the lock pin is retracted, the annulus on the pin is no longer aligned with the other passages and the hydraulic detent circuit is disabled or blocked. Once the hydraulic detent passage is closed, the phaser can be controlled as normal.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
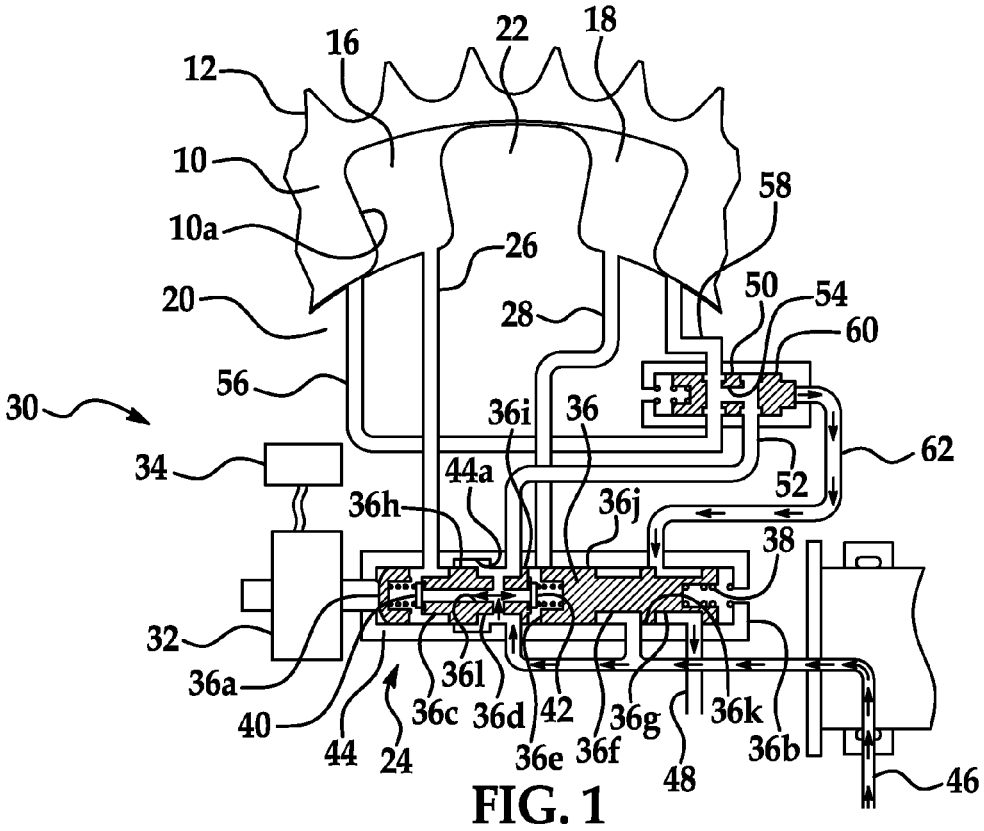
FIG. 1 is a simplified schematic diagram illustrating a phaser moving to a mid position with a hydraulic detent valve integrated into a lock pin.

The term "hydraulic fluid" or simply "fluid" as used herein refers to any type of actuating fluids. The term "actuating fluid" as used herein is a fluid which moves the vanes in a vane phaser. Typically, an actuating fluid can include engine oil, but can also be a separate hydraulic fluid. The term "engine oil" as used herein is defined as the oil used to lubricate engine, oil pressure can be tapped to actuate a phaser through a control valve. The term "vane" as used herein is a radial element that actuating fluid acts on, where the vane is housed within a chamber to divide the space into an advance chamber and a retard chamber. The term "vane phaser" as used herein is a phaser which is actuated by one or more vanes moving in corresponding one or more chambers. The term "chamber" as used herein is defined as a space within which a vane rotates. A chamber can be divided into an advance chamber, which makes valves open sooner relative to the crankshaft rotation, and a retard chamber, which makes valves open later relative to the crankshaft rotation. The term "middle position" of the vane as used herein is defined as a position wherein the side of the vane is not touching any side wall of the cavity of the housing.

The term "check valve" as used herein is defined as a valve which permits fluid flow in only one direction. The term "open loop" as used herein is defined as a control system which changes one characteristic in response to another (e.g., moves a control valve in response to a command from an Engine Control Unit (ECU)) without feedback to confirm the action. The term "closed loop" as used herein is defined as a control system which changes one characteristic in response to another, then checks to see if the change was made correctly and adjusts the action to achieve the desired result (e.g. moves a control valve to change phaser position in response to a command from an Engine Control Unit (ECU), then checks the actual phaser position and moves the control valve again to correct position). The term "control valve" as used herein is a valve which controls flow of fluid to a phaser. The control valve can exist within the phaser in a Cam Torque Actuated (CTA) system. A control valve can be actuated by oil pressure or solenoid. The term "spool valve" as used herein is defined as a control valve of a spool type. Typically a spool reciprocates within bore to connect one or more passages to one another. Most often, the spool is located on a center axis of a rotor of a phaser.

The term "housing" as used herein is defined as the outer part of a phaser with at least one chamber defined therein. An outside surface of the housing can be formed as a pulley (for cooperative engagement with a timing belt), a sprocket (for cooperative engagement with a timing chain) or a gear (for cooperative engagement with a timing gear). The term "hydraulic fluid" as used herein is defined as any kind of oil used in hydraulic cylinders, by way of example and not limitation, such as a brake fluid or a power steering fluid. Hydraulic fluid is not necessarily the same as engine oil. Typically the present invention uses an "actuating fluid" as defined above. The term "lock pin" as used herein is defined as a moveable member disposed to lock a phaser in position. Usually a lock pin is used when oil pressure is too low to hold a phaser in a desired position, such as during engine start or shutdown. The term "driven shaft" as used herein is defined as any shaft which receives power (in a VCT system, most often a camshaft). The term "driving shaft" as used herein is defined as any shaft which supplies power (in a VCT system, most often a crankshaft, however one camshaft can drive another camshaft in some configurations).

The term "phase" as used herein is defined as the relative angular position of camshaft and crankshaft (or camshaft and another camshaft, if phaser is driven by another cam). The term "phaser" as used herein is defined as the entire part which mounts to a cam. The phaser is typically made up of a rotor, a housing, and possibly a spool valve, and a check valve. A piston phaser is a phaser actuated by pistons in cylinders of an internal combustion engine. The term "rotor" as used herein is defined as the inner part of the phaser, which is attached to a cam shaft.

The term "solenoid" as used herein is defined as an electrical actuator which uses electrical current flowing in coil to move a mechanical arm, typically in an on/off (all or nothing) solenoid configuration. The term "Variable Force Solenoid (VFS)" as used herein is defined as a solenoid whose actuating force can be varied, usually by Pulse-Width Modulation (PWM) of supply current.

The term "sprocket" as used herein is defined as a member used with chains such as engine timing chains. The term "timing" as used herein is defined as the relationship between the time a piston reaches a defined position (usually Top Dead Center (TDC)) and the time something else happens. For example, in Variable Cam Timing (VCT) or Variable Valve Timing (VVT) systems, timing usually relates to when a valve opens or closes. Ignition timing relates to when the spark plug fires.

The term "Variable Cam Timing (VCT)" system as used herein can be a Cam Torque Actuated (CTA) VCT system, in which the VCT system uses torque reversals in a camshaft caused by forces corresponding to opening and closing engine valves to move the vane. The control valve in a CTA system allows fluid flow from an advance chamber to a retard chamber, allowing a vane to move, or stops flow, locking a vane in position. The CTA phaser can also have oil input to make up for losses due to leakage, but does not use engine oil pressure to move a phaser.

The term "Valve Control Unit (VCU)" as used herein is defined as control circuitry for controlling the VCT system. Typically the VCU acts in response to commands from the Engine Control Unit (ECU). The term "Engine Control Unit (ECU)" as used herein is defined as a central processing unit (CPU) or computer located in the vehicle.

The term "Variable Cam Timing (VCT)" system as used herein includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between the cam and the crankshafts, in which the crank shaft is connected to the pistons.

Variable Valve Timing (VVT) is any process which changes the valve timing. Variable Valve Timing (VVT) could be associated with Variable Cam Timing (VCT), or could be achieved by varying the shape of the cam or the relationship of cam lobes to cam or valve actuators to cam or valves, or by individually controlling the valves themselves using electrical or hydraulic actuators. In other words, all Variable Cam Timing (VCT) is Variable Valve Timing (VVT), but not all Variable Valve Timing (VVT) is Variable Cam Timing (VCT).

Referring to FIGS. 1-8, a vane-type Variable Cam Timing (VCT) phaser can include a housing 10 with sprocket teeth 12 formed along an outer periphery for meshing driven engagement with a timing chain, or belt, or gear (note shown). Inside the housing 10, a cavity 10*a* is formed. Coaxially within the housing 10, and free to rotate relative to the housing, is a rotor 20 with at least one vane 22 fit within the cavity 10*a* to define a first fluid chamber 16 and a second fluid chamber 18. A control valve 24 can route pressurized actuating fluid or oil via passages 26 and 28 between first and second fluid chambers 16, 18, respectively to drive a vane 22 of rotor 20 in response to cam torque actuation forces. It will be recognized by one skilled in the art that this description is common to vane phasers in general, and the specific arrangement of vanes, chambers, passages and valves shown in FIGS. 1-8 can be varied within the teachings of the invention. For example, the number of vanes and their location can be changed, some phasers have only a single vane, others can have as many as a dozen, and the vanes might be located on the housing and reciprocate within chambers on the rotor. The housing might be driven by a chain or belt or gears, and the sprocket teeth might be gear teeth or a toothed pulley for a belt.

Figure 2:
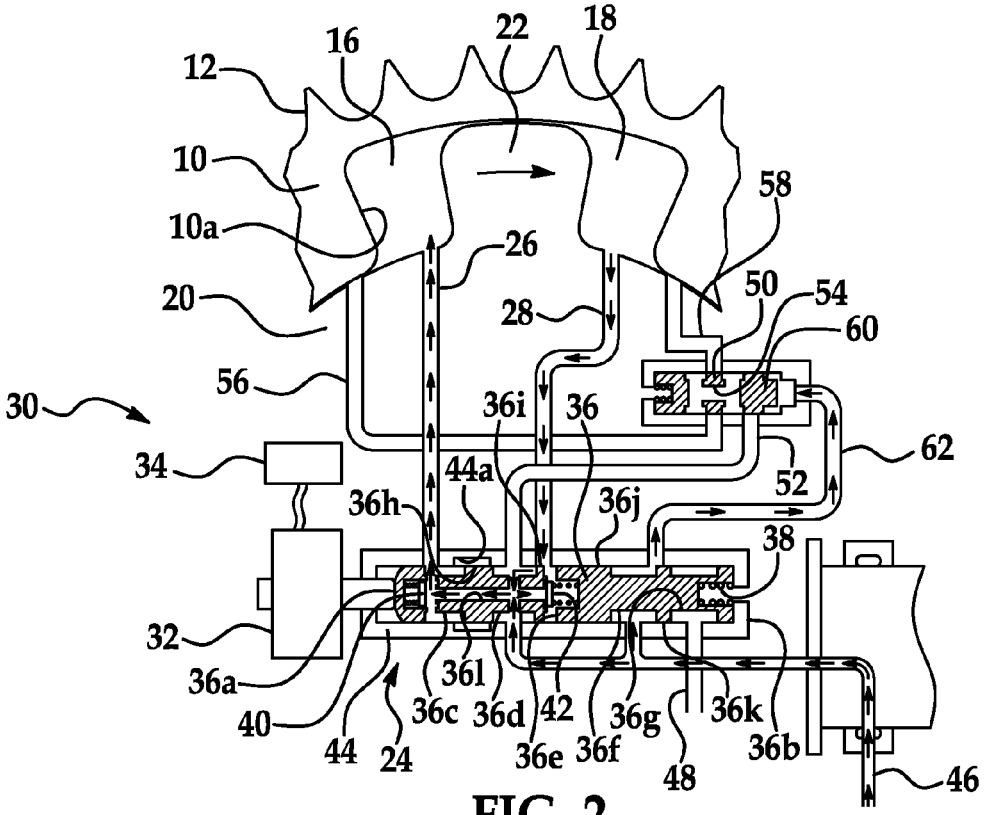
FIG. 2 is a simplified schematic diagram according to FIG. 1 illustrating the phaser moving to an advance position with the hydraulic detent valve integrated into the lock pin.
Figure 3:
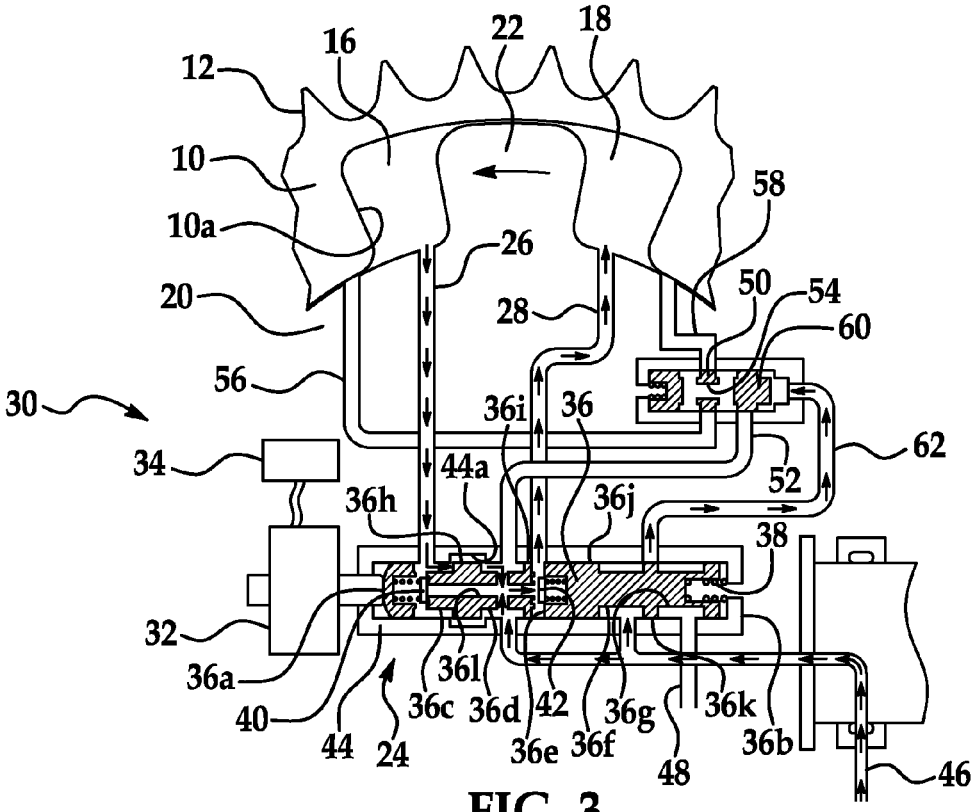
FIG. 3 is a simplified schematic diagram according to FIGS. 1 and 2 illustrating the phaser moving to a retard position with the hydraulic detent valve integrated into the lock pin.
Figure 4:
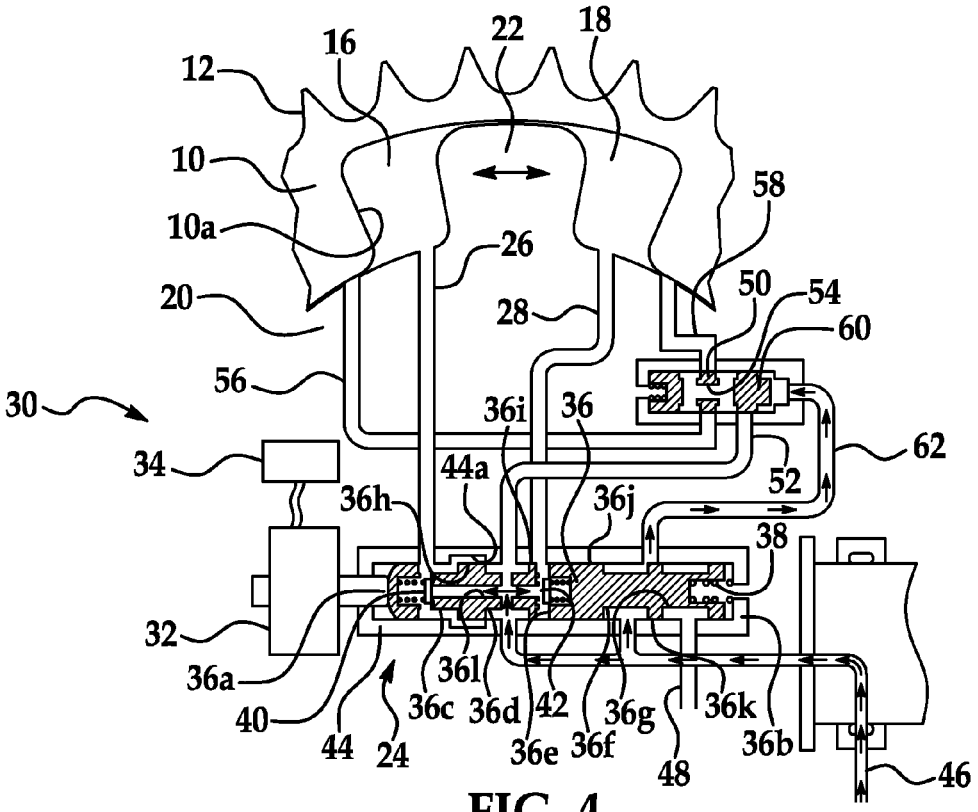
FIG. 4 is a simplified schematic diagram according to FIGS. 1-3 illustrating the phaser holding position with the hydraulic detent valve integrated into the lock pin.
Figure 5:
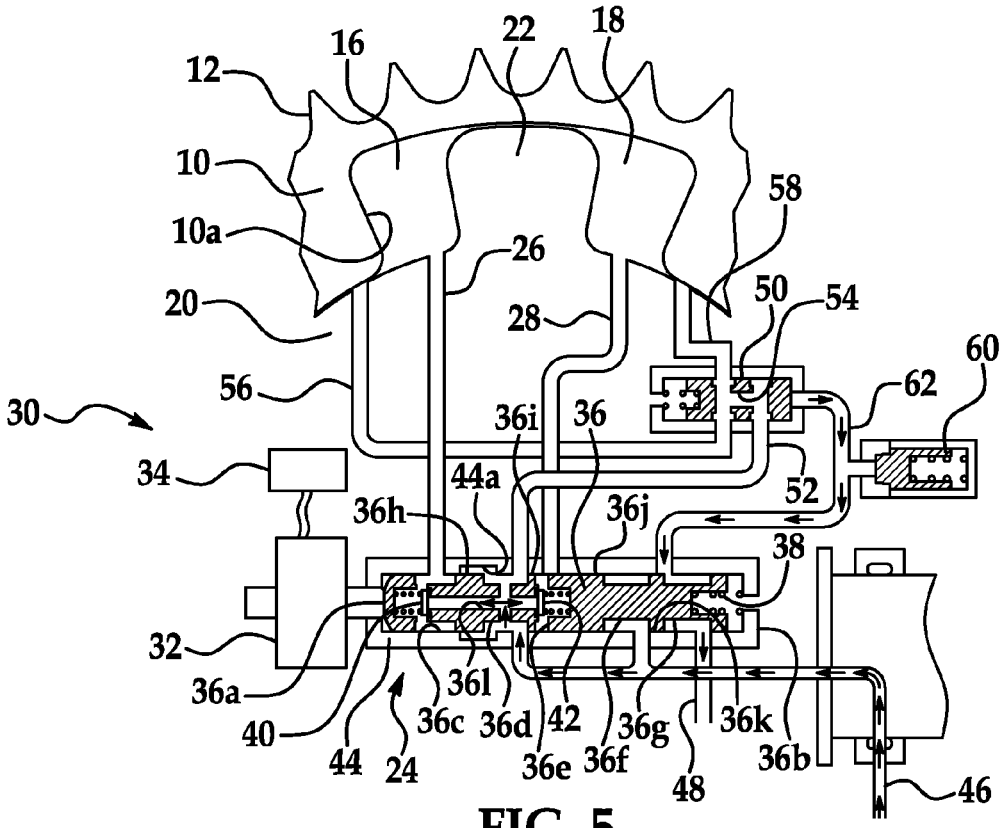
FIG. 5 is a simplified schematic diagram illustrating a phaser moving to mid position with a hydraulic detent valve separate from a lock pin.
Figure 6:
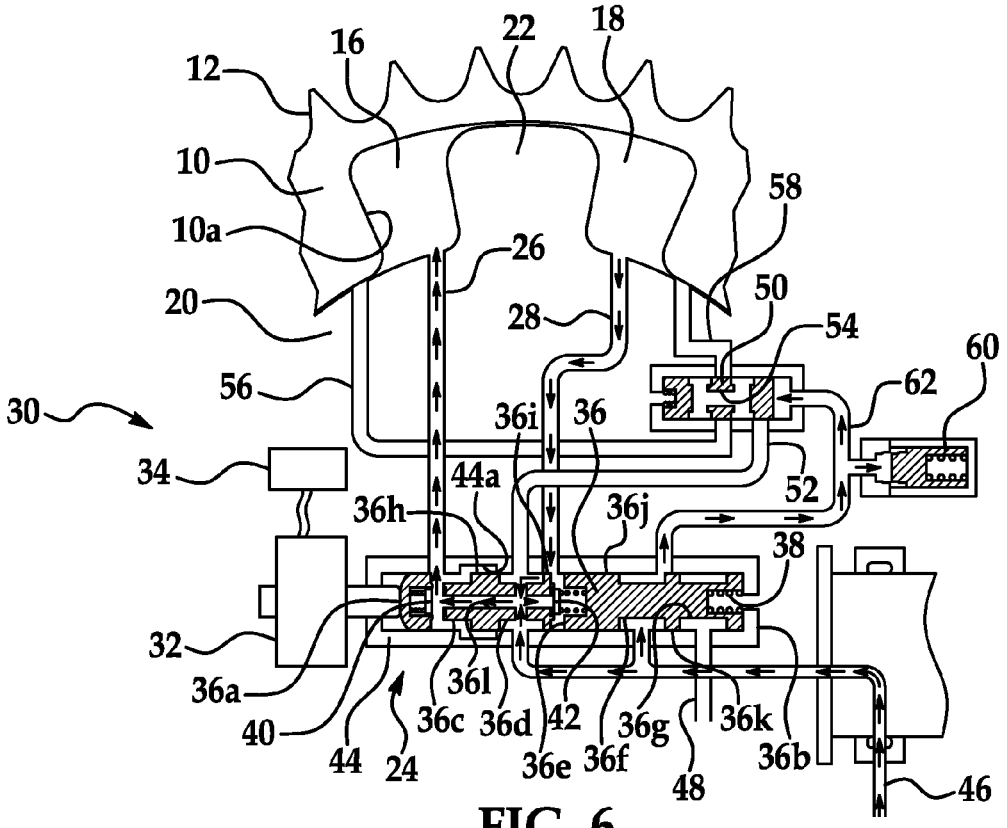
FIG. 6 is a simplified schematic diagram according to FIG. 5 illustrating the phaser moving to an advance position with the hydraulic detent valve separate from the lock pin.
Figure 7:
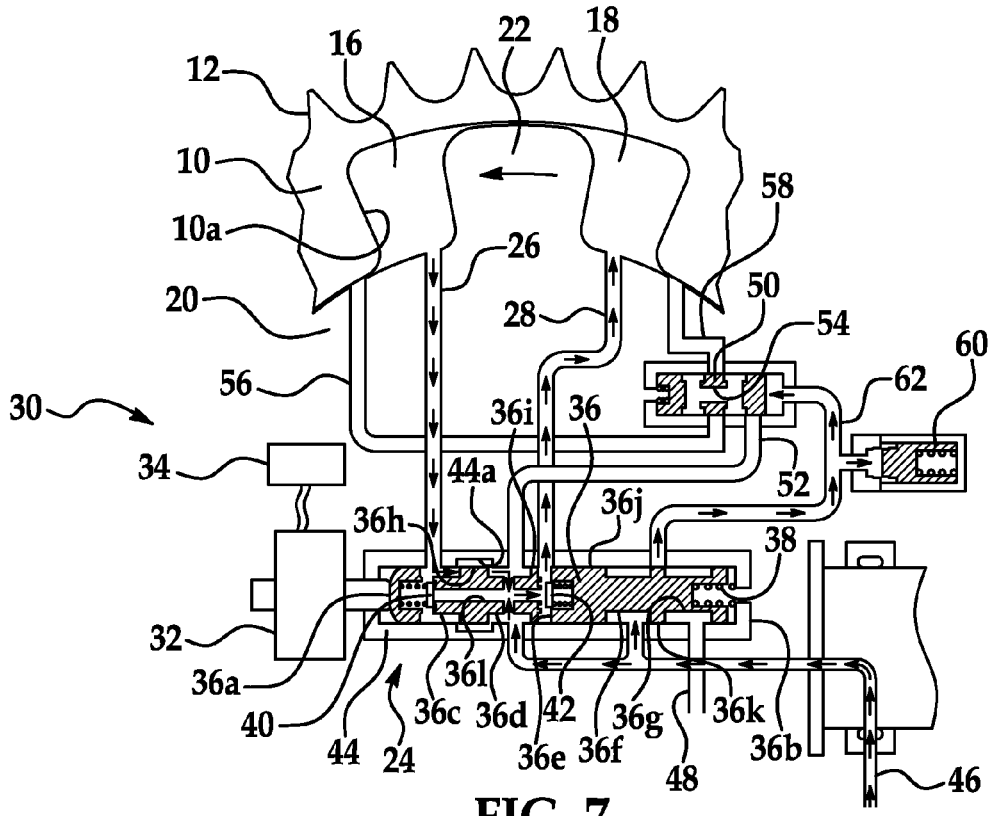
FIG. 7 is a simplified schematic diagram according to FIGS. 5 and 6 illustrating the phaser moving to a retard position with the hydraulic detent valve separate from the lock pin.
Figure 8:
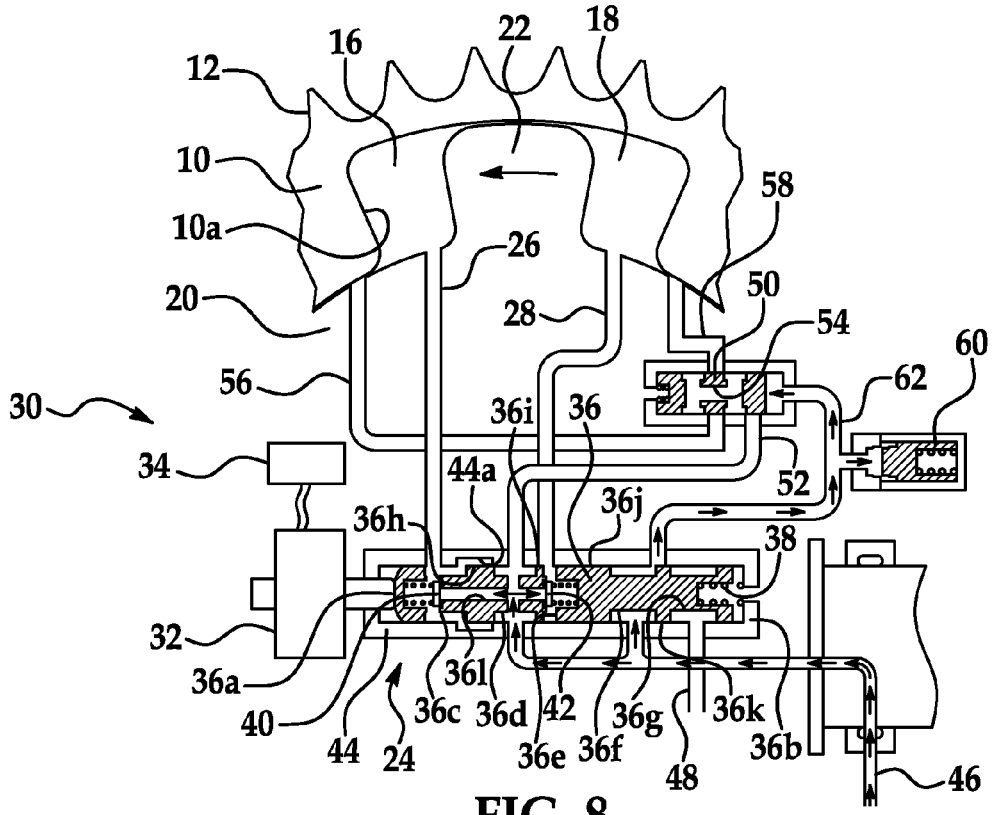
FIG. 8 is a simplified schematic diagram according to FIGS. 5-7 illustrating the phaser moving to a holding position with the hydraulic detent valve separate from the lock pin.

FIGS. 1-8 illustrate a typical hydraulic schematic of a Cam Torque Actuated (CTA) Variable Cam Timing (VCT) mechanism 30. An actuator or Valve Control Unit (VCU) 32, by way of example and not limitation, such as a Variable Force Solenoid (VFS), can be controlled by a controller or Engine Control Unit (ECU) 34, using either open loop or closed loop control sequences, to position the control valve 24, by way of example and not limitation, such as a spool-type control valve 24 as shown, for completing a set of fluid circuits. By engaging the spool-type control valve 24 via a force exerted on a first end 36*a* of the spool 36 of the control valve 24, an equilibrium position can be achieved by an equal force exerted on a second end 36*b* of the spool 36 of the control valve 24 by means of an elastic member 38, such as a spring. The spool 36 defines five reduced diameter chambers 36*c*, 36*d*, 36*e*, 36*f*, 36*g* separated by larger diameter lands 36*h*, 36*i*, 36*j*, 36*k*. A central passage 36*l* connects chamber 36*d* with chambers 36*c*, 36*e* through ports controlled by internal spool spring biased check valves 40, 42 respectively. The spool 36 is moveable between a first position adjacent a first end limit of travel (as shown in FIGS. 1 and 5), a second position adjacent a second end limit of travel (as shown in FIGS. 2 and 6), a third position intermediate the first and second positions (as shown in FIGS. 3 and 7), and a fourth position intermediate the first and second positions (as shown in FIGS. 4 and 8). The control valve 24 can include a valve housing 44 with an enlarged diameter, check valve bypass passage 44*a* allowing communication between chambers 36*c*, 36*d* when the spool 36 is in the third position (as shown in FIGS. 3 and 7). Fluid passage 26 is in fluid communication with chamber 36*c* of the spool. Fluid passage 28 is in fluid communication with chamber 36*e*, and can bypass land 36*i* to be in fluid communication with chamber 36*d* when the spool 36 is in the second position (as shown in FIGS. 2 and 6). A source of pressurized actuating fluid or oil is supplied through fluid supply source passage 46 to chambers 36*d*, 36*f* of the spool 36. An exhaust vent or exhaust passage 48 is in fluid communication with chamber 36*g* of the spool 36.

Referring now to FIGS. 1 and 5, when the spool 36 is in the first position, the pressurized actuating fluid supply passage 46 is in fluid communication with chamber 36*d* of the spool 36 in the control valve 24 to make up for fluid losses due to leakage. The internal passage 36*l* is closed at each end by internal spool spring biased check valves 40, 42 respectively. A spring biased detent valve 50 is moveable between a normally open position (as shown in FIGS. 1 and 5) and a closed position (as shown in FIGS. 2-4 and FIGS. 6-8). When in the open position, the detent valve 50 is in fluid communication through passage 52 with the pressurized actuating fluid supply source in chamber 36*d*. Pressurized fluid is supplied through actuating fluid supply source passage 46 to chamber 36*d* of spool 36 to make up for any fluid losses in the circuit for fluid communication with chambers 16, 18 respectively through detent passages 52, 54, 56, 58. Flow of actuating fluid between chambers 16, 18 is controlled by the relative angular position of the rotor 20 with respect to an endplate 64 or a sprocket 70.

Portions of passages 56, 58 extend through both the rotor 20 and either the endplate 64 or sprocket 70 to define passage portions with metering pockets or edges 64*a*, 64*b* at the interface between the rotor 20 and either the endplate 64 or sprocket 70 for controlling actuating fluid flow through passages 56, 58 in response to an angular position of the rotor with respect to the endplate 64 or sprocket 70. As a result of the placement of the ports of passages 56, 58 opening into chambers 16, 18 respectively and the application of Cam Torque Actuated (CTA) forces, the vane 22 can be moved toward an intermediate or mid position. As can be appreciated, the end result of the flow of fluid is a stoppage of the rotation of the rotor 20 relative to the housing 10, or at least slowing down the rate of rotation sufficiently enough in an intermediate position for a lock pin 60 to lock the housing 10 and the rotor 20 at the intermediate or mid position, whereby the intermediate or mid position can be maintained independent of fluid flow. A lock pin 60, formed either integrally with the detent valve (as shown in FIGS. 1-4) or formed separately from the detent valve (as shown in FIGS. 5-8), is moveable between a locked position (as shown in FIGS. 1 and 5) and a released position (as shown in FIGS. 2-4 and FIGS. 6-8). When the spool 36 is in the first position, the lock pin is in fluid communication with the exhaust passage 48 through passage 62 and chamber 36*g* of the spool 36 and is spring biased into the locked position.

As best seen in FIGS. 2 and 6, when the spool 36 is in the second position, the pressurized actuating fluid supply source passage 46 is in fluid communication with the lock pin 60 through chamber 36*f* and passage 62 driving the lock pin 60 from the locked position to the released position. Additionally, the detent valve 50 is driven from the open position to the closed position, isolating the internal passage 54 from passages 56, 58. The pressurized actuating fluid or oil introduced by control valve 24 through passage 46 makes up for any fluid losses in the circuit. The chambers 16, 18 are in fluid communication through chamber 36*d*, internal spool passage 36*l*, passing through open check valve 40 and into chamber 36*c* for fluid communication with passage 26, driven by the cam torque actuation forces of the Cam Torque Actuated (CTA) mechanism to push or rotate vane 22 clockwise relative to the housing 10, forcing actuating fluid or oil out of chamber 18 into passage 28 and into control valve 24. As the rotor 20 rotates clockwise into an advance timing position, vane 22 rotates along with the rotor since vane is rigidly attached to the rotor. As a result of the Cam Torque Actuated (CTA) mechanism, fluid flows out of chamber 18 via passage 28 to chamber 36*e* where internal spool check valve 42 stops the fluid flow therethrough, but a fluid circuit is still completed by having fluid flowing from passage 28 bypassing land 36*i* into chamber 36*d* with the spool 36 positioned in the second position. A substantial amount of fluid in passage 36*l* flows through internal spool check valve 40 through passage 26 into chamber 16. The end result of the above described fluid flow is that the rotor 20, and any associated vane 22, rotates in relation to the housing 10 toward an advance timing position. More specifically, vane 22 moves clockwise within the cavity 10*a* of the housing 10 as the result of the above described fluid flow.

As best seen in FIGS. 3 and 7, when the spool 36 is in the third position, the pressurized fluid supply passage 46 is isolated from fluid communication with the lock pin 60 by land 36*k* to maintain the lock pin 60 in the released position. Additionally, the detent valve 50 is correspondingly held in the closed position, isolating the internal passage 54 from passages 52, 56, 58. The pressurized actuating fluid or oil introduced by control valve 24 through passage 46 makes up for any losses of fluid in the circuit. Chambers 16, 18 are in fluid communication with one another through chamber 36*d*, internal spool passage 36*l*, passing through open check valve 42 and into chamber 36*e* for fluid communication with passage 28, driven by the cam torque actuation forces of the Cam Torque Actuated (CTA) mechanism to push or rotate vane 22 counterclockwise relative to the housing 10 toward a retard timing position, forcing actuating fluid or oil out of chamber 16 into passage 26 and into control valve 24. As the rotor 20 rotates counterclockwise, vane 22 rotates along with the rotor since vane is rigidly attached to the rotor. As a result of the Cam Torque Actuated (CTA) mechanism, fluid flows out of chamber 16 via passage 26 to chamber 36*c* where internal spool check valve 40 stops the fluid flow therethrough, but a fluid circuit is still completed by having fluid flowing from passage 26 bypassing land 36*h* through check valve bypass passage 44*a* in valve housing 44 into chamber 36*d* with the spool 36 positioned in the third position. A substantial amount of fluid in passage 36*l* flows through internal spool check valve 42 through passage 28 into chamber 18. The end result of the above described fluid flow is that the rotor 20, and any associated vane 22, rotates in relation to the housing 10 toward a retard timing position. More specifically, vane 22 moves counterclockwise within the cavity 10*a* of the housing 10 as the result of the above described fluid flow.

Referring now to FIGS. 4 and 8, when the spool 36 is in the fourth position, the pressurized fluid supply passage 46 is in fluid communication with the lock pin 60 thereby maintaining the lock pin 60 in the released position. Additionally, the detent valve 50 is correspondingly held in the closed position, isolating the internal passage 54 from passages 52, 56, 58. The pressurized actuating fluid or oil introduced by control valve 24 through passage 46 makes up for any losses of fluid in the circuit. Chambers 16, 18 are not in fluid communication through chamber 36*d*, since internal spool passage 36*l* is blocked by closure of normally closed, spring biased, check valves 40, 42 from flowing into chamber 36*c*, 36*e*, and lands 36*h*, 36*i* are sealed to isolate chambers 36*c* 36*e* from chamber 36*d*. The end result of the above described configuration is that the rotor 20, and any associated vane 22, is in a holding position in relation to the housing 10. More specifically, vane 22 moves with the housing 10 as the result of the above described fluid flow without relative motion therebetween.

Figure 9:
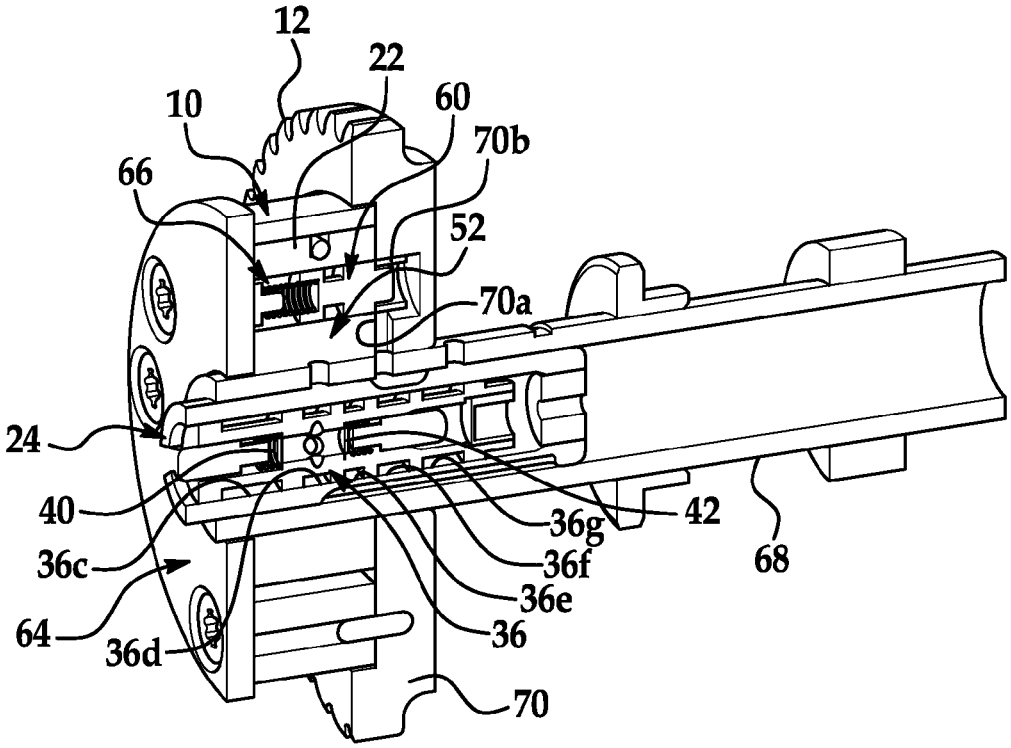
FIG. 9 is a cross section of a mid position lock phaser with a hydraulic detent circuit.
Figure 10:
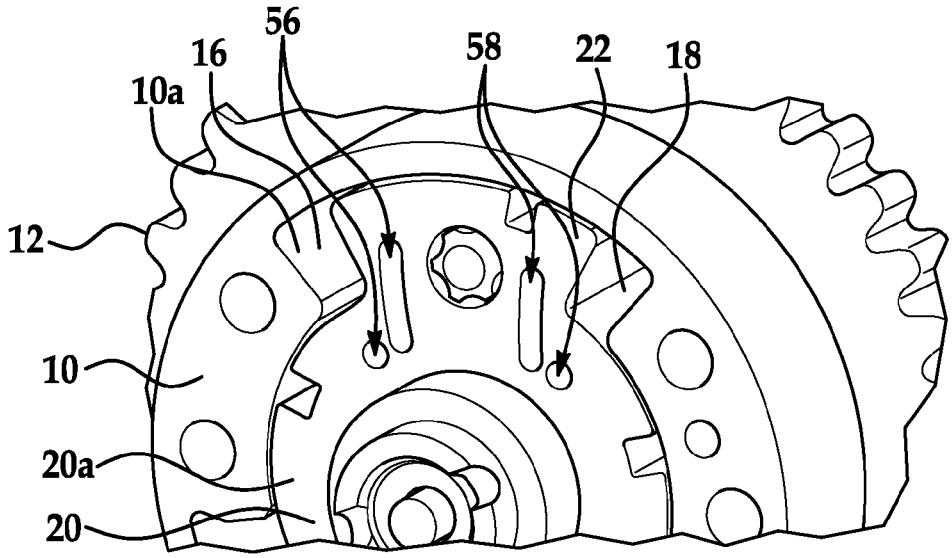
FIG. 10 is an end view of hydraulic detent passages in a rotor with hydraulic detent circuitry formed in a face of the rotor.
Figure 11:
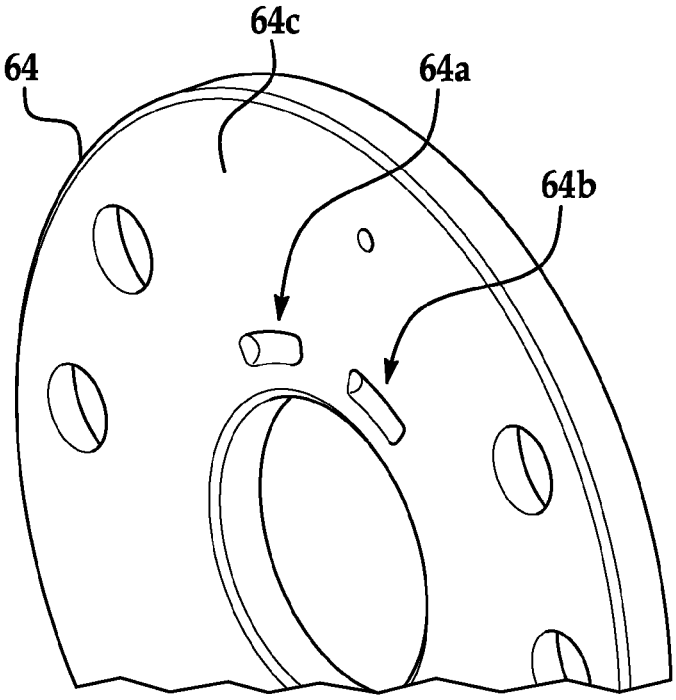
FIG. 11 is a detail end view of a hydraulic detent pocket in an endplate with hydraulic detent circuitry formed in a face of the endplate.
Figure 12:
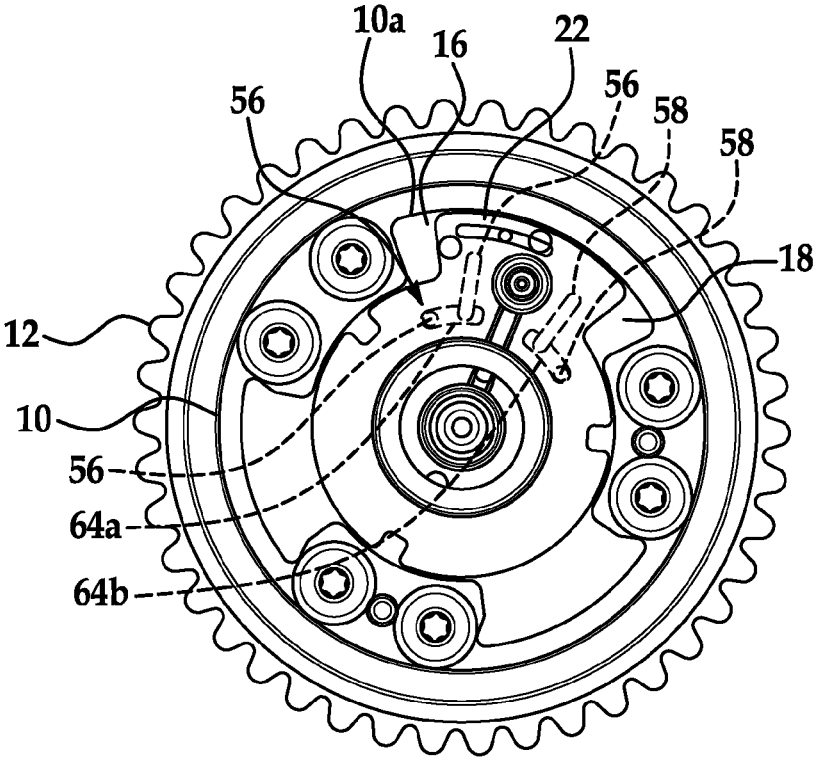
FIG. 12 is an end view of hydraulic detent passages in a phaser.

Referring now to FIG. 9, a cross section of a Variable Cam Timing (VCT) phaser for an internal combustion engine having at least one camshaft 68 having a mid position lock with hydraulic detent is illustrated. A vane-type Variable Cam Timing (VCT) phaser can include a housing 10 with sprocket teeth 12 formed along an outer periphery for meshing driven engagement with a timing chain, or belt, or gear (not shown). As best seen in FIG. 10, inside the housing 10, a cavity 10*a* is formed. Coaxially within the housing 10, and free to rotate relative to the housing, is a rotor 20 with at least one vane 22 fit within the cavity 10*a* to define a first fluid chamber 16 and a second fluid chamber 18. Referring again to FIG. 9, a control valve 24 can route pressurized actuating fluid or oil via passages 26 and 28 between first and second fluid chambers 16, 18, respectively to drive a vane 22 of rotor 20 in response to cam torque actuation forces. The spool 36 of the control valve 24 defines five reduced diameter chambers 36*c*, 36*d*, 36*e*, 36*f*, 36*g* separated by larger diameter lands 36*h*, 36*i*, 36*j*, 36*k*. A central passage 36*l* connects chamber 36*d* with chambers 36*c*, 36*e* through ports controlled by internal spool, normally closed, spring biased, check valves 40, 42 respectively. A lock pin 60, as illustrated in FIG. 9, is formed integrally with the detent valve 50 and is moveable between a locked position and a released position, while the detent valve 50 is moveable between an open position and closed position, respectively. As best seen in FIGS. 10-12, the hydraulic detent circuit includes passages 56, 58 having portions located in a face 20*a* of the rotor 20 facing an endplate 64 with corresponding pockets 64*a*, 64*b* defining another portion of the hydraulic detent passages 56, 58. It should be recognized that the pockets forming portions of the passages 56, 58 could be formed in the sprocket 70 if desired without departing from the present disclosure. Further, it should be recognized that the end plate 64 can include a sprocket 70. Pockets 64*a*, 64*b* forming portions of the passages 56, 58 can be formed in either one of the endplate 64 and sprocket 70, or can be formed in both the endplate 64 and the sprocket 70. Additionally, it should be recognized that the angular position of the sprocket can be fixed relative to the rotor 20 or the endplate 64 of the housing 10, depending on the mode of operation desired: i.e. either a captured housing mode of operation or a captured rotor mode of operation.

A cam torque actuated (CTA) phaser with normally closed, spring biased, check valves 40, 42 located internally within spool 36 of control valve 24 can operably actuate a hydraulic detent valve 50 and lock pin 60 allowing a mid position lock through hydraulic detent passages 52, 54, 56, 58, where portions of passages 56, 58 extend through both the rotor 20 and the endplate 64. A metering edge or edges of pockets 64*a*, 64*b* of the hydraulic detent passages 56, 58 can be controlled by an angular position of the rotor 20 relative to the endplate 64. The hydraulic detent circuit can be activated by a position of a lock pin 60, where the detent valve 50 can be integrated into the lock pin, but it is not necessary to do so. The lock pin 60 can have two functions: first, to lock a phaser in a base timing position; and second, as a switch or actuator for opening and closing the hydraulic detent passages 52, 54, 56, 58. A metering edge or edges of pockets 64*a*, 64*b* for the hydraulic detent passages 56, 58 can be located between the endplate 64 and the rotor 20, or alternatively can be located between the rotor 20 and sprocket 70.

To lock the phaser, spool 36 can be positioned full out, where a lock passage 62 supplying actuating fluid or oil to a nose of the lock pin 60 is blocked and a vent passage 48 is opened allowing any remaining actuating fluid or oil in the lock passage 62 to be vented out exhaust passage 48 through chamber 36*g* of the spool 36. A spring 66 on a back side of the lock pin 60 pushes the lock pin 60 till the nose contacts a face 64*c* of the endplate 64 or a face 70*a* of a sprocket 70 which in turn allows an annulus 54 on the lock pin 60 to be aligned with three passages 52, 56, 58, where one passage 56 connects to an advance chamber 16, another passage 58 connects to a retard chamber 18 and a last passage 52 connects to a pressurized fluid supply passage 46 through chamber 36*e* of spool 36. Depending on a position of the rotor 20, the portions of two passages 56, 58 connected to the chambers 16, 18 are able to open and close, causing the rotor 20 to move to a lock position in response to cam torque actuation forces, which only occurs when the lock pin nose is against the sprocket 70 or endplate 64. When the rotor 20 and endplate 64 or sprocket 70 are aligned in the locked position, the lock pin 60 is able to fall into a corresponding aperture 70*b* to lock the phaser. The two passages 56, 58 are controlled by the rotor 20 to endplate 64 relative angular position providing a configuration that does not require an internal bearing.

To unlock the phaser, the spool 36 of control valve 24 is pushed inward blocking the vent passage 48 and allowing a supply of pressurized actuating fluid or oil to be feed to the nose of the lock pin 60 through passage 62, the supply of pressurized actuating fluid or oil pushes against the nose of the lock pin 60 causing the lock pin 60 to retract which unlocks the phaser (compressing the lock pin spring 66). Once the lock pin 60 is retracted, the annulus 54 on the lock pin 60 is no longer aligned with the other passages 52, 56, 58 and the hydraulic detent circuit is disabled or blocked. Once the hydraulic detent passages 52, 56, 58 are closed, the phaser can be controlled as normal.

The position of the spool 36 of the control valve 24 determines the direction and rate of change of phase but typically requires a position feed back sensor on the camshaft in order to stop in a specific mid phase position. At this juncture, it is desirous to keep the specific mid-phase position independent of actuating fluid or oil flow. The lock pin 60 can lock the VCT phaser during conditions where the engine oil pump is not supplying any actuating fluid or oil to the VCT phaser such as during the engine cranking cycle. The lock pin 60 can be located at any intermediate or mid position between either extreme end limit of travel within the VCT phaser mechanism. The VCT phaser can operate in an "open loop" mode and be commanded to the stop where the lock pin 60 will engage. The fluid flow through detent passages 52, 54, 56, 58 positions the rotor 20 in the proper position relative to the endplate 64 for the lock pin 60 to reliably engage.

In the case of a cam torque actuated (CTA) VCT phaser, when the spool 36 of control valve 24 is set to one end of stroke (as illustrated in FIGS. 2-3 or FIGS. 6-7), the actuating fluid, such as oil, is allowed to exhaust from one chamber 16 or 18 and fill another 18 or 16, e.g. from the first chamber to the second chamber. For example, chamber 16 can be an advance chamber and chamber 18 accordingly can be the retard chamber. If the actuating fluid is in fluid communication between the advance chamber 16 and the retard chamber 18 (as illustrated in FIGS. 1 and 5), the camshaft will move toward a mid position for locking. If the actuating fluid is exhausted from the retard chamber 18 and allowed to fill the advance chamber 16 (as illustrated in FIGS. 2 and 6), the camshaft will reach the advance phase position. If the actuating fluid is exhausted from the advance chamber 16 and allowed to fill the retard chamber 18 (as illustrated in FIGS. 3 and 7), the camshaft will reach the retard phase position. If the actuating fluid is blocked from movement between the advance chamber 16 and the retard chamber 18 (as illustrated in FIGS. 4 and 8), the camshaft will in a holding phase position.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A phaser including a housing (10) and a rotor (20) disposed to rotate relative to each other and enclosed by an endplate (64), the housing (10) having at least one cavity (10*a*) disposed to be divided by a vane (22) rigidly attached to the rotor (20), the vane (22) dividing the cavity (10*a*) into a first chamber (16) and a second chamber (18), the phaser further including passages (26, 28, 56, 58) connecting the first and second chambers (16, 18) facilitating oscillation of the vane (22) within the cavity (10*a*), one of the rotor (20) and the endplate (64) having a fixed angular position with respect to a sprocket (70), the phaser comprising:

a detent valve (50) moveable between an open position and a closed position, when in the open position connecting a detent passage (56, 58) extending through the rotor (20) and through the endplate (64) allowing pressurized actuating fluid flow with respect to the first and second chambers (16, 18) in response to a relative angular position of the rotor (20) and the endplate (64) with respect to one another; and a lock pin (60) moveable between a locked position and a released position, where the lock pin (60) is in the locked position when the detent valve (50) is in the open position to lock the housing (10) and the rotor (20) together independent of actuating fluid flow.

2. The phaser of claim 1 further comprising:

the housing (10) connected coaxially with respect to a camshaft (68).

3. The phaser of claim 2 further comprising:

the rotor (20) rotatable coaxially with respect to the housing (10) and having a vane (22) located within each cavity (10*a*) of the housing (10) and dividing each cavity (10*a*) into a first chamber (16) and a second chamber (18).

4. The phaser of claim 1 further comprising:

the lock pin (60) formed integrally with the detent valve (50).

5. The phaser of claim 1 further comprising:

the lock pin (60) formed separately from the detent valve (50).

6. The phaser of claim 1 further comprising:

a control valve (24) having a spring biased spool (36) with internally located first and second check valves (40, 42), the spool (36) operably connecting an actuating fluid supply source (46) selectively between the first chamber (16) and the second chamber (18), and operably connecting the lock pin (60) and detent valve (50) between an exhaust vent (48) and the actuating fluid supply source (46).

7. The phaser of claim 6 further comprising:

a variable force solenoid (32) operating the spool (36) of the control valve (24) in response to input from an engine control unit (34), the variable force solenoid (32) selectively moving the spool (36) of the control valve (24) with respect to a base timing position, where the lock pin (60) is in the locked position and the detent valve (50) is in the open position.

8. The phaser of claim 6 further comprising:

a variable force solenoid (32) operating the spool (36) of the control valve (24) in response to input from an engine control unit (34), the variable force solenoid (32) selectively moving the spool (36) of the control valve (24) with respect to an advance timing position, where cam torque actuation forces drive actuating fluid from the second chamber (18) through the spool (36) of the control valve (24) to the first chamber (16), the lock pin (60) is in the released position and the detent valve (50) is in the closed position.

9. The phaser of claim 6 further comprising:

a variable force solenoid (32) operating the spool (36) of the control valve (24) in response to input from an engine control unit (34), the variable force solenoid (32) selectively moving the spool (36) of the control valve (24) with respect to a retard timing position, where cam torque actuation forces drive actuating fluid from the first chamber (16) through the spool (36) of the control valve (24) to the second chamber (18), the lock pin (60) is in the released position and the detent valve (50) is closed.

10. The phaser of claim 6 further comprising:

a variable force solenoid (32) operating the spool (36) of the control valve (24) in response to input from an engine control unit (34), the variable force solenoid (32) selectively moving the spool (36) of the control valve (24) with respect to a phaser holding position, where the first and second chambers (16, 18) are isolated from one another by the position of the spool (36) of the control valve (24) and closure of the internally located first and second check valves (40, 42), the lock pin (60) is in the released position, and the detent valve (50) is in the closed position.

11. A variable cam timing phaser for an internal combustion engine having at least one camshaft (68) comprising:

a housing (10) connected coaxially with respect to a camshaft (68) and defining at least one cavity (10*a*);

a rotor (20) rotatable coaxially with respect to the housing (10) and having a vane (22) located within each cavity (10*a*) of the housing (10) and dividing each cavity (10*a*) into a first chamber (16) and a second chamber (18);

an endplate (64) enclosing the rotor (20) with respect to the housing (10), one of the rotor (20) and the endplate (64) having a fixed angular position with respect to a sprocket (70);

a detent passage (56, 58) extending through the rotor (20) and through the endplate (64) to be in fluid communication with each of the first and second chambers (16, 18), where fluid flow with respect to the first and second chambers (16, 18) is controlled in response to a relative angular position of the rotor (20) and the endplate (64) with respect to one another;

a lock pin (60) moveable between a locked position and a released position; and a detent valve (50) located in the detent passage (56, 58) and moveable between an open position corresponding to the lock pin (60) being in the locked position, and a closed position corresponding to the lock pin (60) being in the released position, when in the open position a pressurized actuating fluid supply source (46) is in fluid communication with the detent passage (56, 58) extending through the rotor (20) and endplate (64) and is controlled in response to a relative angular position of the rotor (20) with respect to the endplate (64).

12. The variable cam timing phaser of claim 11 further comprising:

the lock pin (60) operating as an actuator for the detent valve (50).

13. The variable cam timing phaser of claim 11 further comprising:

a control valve (24) having a spool (36) with internally located first and second check valves (40, 42), the spool (36) operably connecting an actuating fluid supply source (46) selectively between the first chamber (16) and the second chamber (18) through the rotor (20), and operably connecting the lock pin (60) and detent valve (50) between an exhaust vent (48) and the actuating fluid supply source (46) through passages (62) in the rotor (20).

14. The variable cam timing phaser of claim 13 further comprising:

a variable force solenoid (32) operating the spool (36) of the control valve (24) in response to input from an engine control unit (34), the variable force solenoid (32) selectively moving the spool (36) of the control valve (24) between a first position where the lock pin (60) is in the locked position and the detent valve (50) is in the open position, a second position where cam torque actuation forces drive actuating fluid from the second chamber (18) through the spool (36) of the control valve (24) to the first chamber (16), the lock pin (60) is in the released position and the detent valve (50) is in the closed position, a third position where cam torque actuation forces drive actuating fluid from the first chamber (16) through the spool (36) of the control valve (24) to the second chamber (18), the lock pin (60) is in the released position and the detent valve (50) is closed, and a fourth position where the first and second chambers (16, 18) are isolated from one another by the position of the spool (36) of the control valve (24) and closure of the internally located first and second check valves (40, 42), the lock pin (60) is in the released position and the detent valve (50) is in the closed position.

15. A cam torque actuated variable cam timing phaser for an internal combustion engine having at least one camshaft (68) comprising:

a housing (10) connected coaxially with respect to the camshaft (68) and defining at least one cavity (10*a*);

a rotor (20) rotatable coaxially with respect to the housing (10) and having a vane (22) rotatably located within each cavity (10*a*) of the housing (10) and dividing each cavity (10*a*) into a first chamber (16) and a second chamber (18);

an endplate (64) enclosing the rotor (22) with respect to the housing (10), one of the rotor (20) and the endplate (64) having a fixed angular position with respect to a sprocket (70);

a detent passage (56, 58) extending through the rotor (20) and through the endplate (64) to be in fluid communication with each of the first and second chambers (16, 18), where fluid flow with respect to the first and second chambers (16, 18) is controlled in response to a relative angular position of the rotor (20) and the endplate (64) with respect to one another;

a spring biased lock pin (60) moveable between a locked position providing base timing and a released position;

a spring biased detent valve (50) in an open position when the lock pin (60) is in the locked position and in a closed position when the lock pin (60) is in the released position;

a control valve (24) having a spring biased spool (36) with a spring biased first check valve (40) and a spring biased second check valve (42) disposed within the spool (36), the spool (36) operably connecting an actuating fluid supply source (46) selectively between the first chamber (16) and the second chamber (18) through the rotor (20), and operably connecting the lock pin (60) and detent valve (50) between an exhaust vent (48) and the actuating fluid supply source (46) through the detent passage (56, 58) extending through the rotor (20) and endplate (64); and a variable force solenoid (32) operating the spool (36) of the control valve (24) in response to input from an engine control unit (34), the variable force solenoid (32) selectively moving the spool (36) of the control valve (24) between a first position corresponding to a base timing position, where the lock pin (60) is in the locked position and the detent valve (50) is in the open position allowing fluid communication between a pressurized actuating fluid supply (46) and the detent passage (56, 58) to be controlled in response to a relative angular position of the rotor (20) with respect to the endplate (64), a second position corresponding to an advance timing position, where cam torque actuation forces drive actuating fluid from the second chamber (18) through the spool (36) of the control valve (24) to the first chamber (16), the lock pin (60) is in the released position and the detent valve (50) is in the closed position, a third position corresponding to a retard timing position, where cam torque actuation forces drive actuating fluid from the first chamber (16) through the spool (36) of the control valve (24) to the second chamber (18), the lock pin (60) is in the released position and the detent valve (50) is closed, and a fourth position corresponding to a phaser holding position, where the first and second chambers (16, 18) are isolated from one another by the position of the spool (36) of the control valve (24) and closure of the first and second check valves (40, 42), the lock pin (60) is in the released position and the detent valve (50) is in the closed position.

* * * * *